US008424270B2

(12) United States Patent
Ratko et al.

(10) Patent No.: US 8,424,270 B2
(45) Date of Patent: Apr. 23, 2013

(54) GELATIN RIBBON PRINTING METHOD AND APPARATUS

(75) Inventors: Michael J. Ratko, Dorval (CA); Nader Mamizadeh, Montreal (CA); Jeffrey Martin Danta, Pointe-Claire (CA)

(73) Assignee: GI Sportz, Inc., St. Laurent, Quebec (CA)

( * ) Notice: Subject to any disclaimer, the term of this patent is extended or adjusted under 35 U.S.C. 154(b) by 1371 days.

(21) Appl. No.: 11/084,152

(22) Filed: Mar. 21, 2005

(65) Prior Publication Data

US 2005/0237371 A1 Oct. 27, 2005

Related U.S. Application Data

(60) Provisional application No. 60/564,692, filed on Apr. 26, 2004.

(51) Int. Cl.
*B65B 57/02* (2006.01)

(52) U.S. Cl.
USPC ..... 53/64; 347/103; 53/454; 53/131.5; 53/389.4; 53/560

(58) Field of Classification Search ..... 347/2, 103; 53/454, 64, 131.5, 389.4, 560; 11/2
See application file for complete search history.

(56) References Cited

U.S. PATENT DOCUMENTS

| | | | | |
|---|---|---|---|---|
| 3,103,165 | A * | 9/1963 | Tripp | 101/35 |
| 3,333,031 | A * | 7/1967 | Vincent, Jr. et al. | 264/134 |
| 3,374,303 | A * | 3/1968 | Metz, Jr. | 264/216 |
| 3,395,202 | A | 7/1968 | Yen | |
| 3,616,750 | A | 11/1971 | Gottcho et al. | |
| 3,868,900 | A * | 3/1975 | Ackley | 101/40 |
| 3,956,872 | A * | 5/1976 | Johnson | 53/131.2 |
| 4,377,971 | A * | 3/1983 | Ackley | 101/40 |
| 4,432,282 | A * | 2/1984 | Jurinak | 101/350.5 |
| 4,567,714 | A * | 2/1986 | Chasman | 53/438 |
| 4,922,682 | A * | 5/1990 | Tait et al. | 53/137.2 |
| 5,054,258 | A * | 10/1991 | Tait et al. | 53/137.2 |
| 5,246,635 | A * | 9/1993 | Ratko et al. | 264/4 |
| 5,317,849 | A * | 6/1994 | Sauter | 53/284.5 |
| 5,722,324 | A * | 3/1998 | Nishiwaki et al. | 101/363 |
| 5,735,105 | A * | 4/1998 | Stroud et al. | 53/411 |
| 5,761,886 | A * | 6/1998 | Parkhideh | 53/454 |
| 6,073,555 | A * | 6/2000 | Billington, III | 101/127.1 |
| 6,769,226 | B2 * | 8/2004 | Holland et al. | 53/411 |

(Continued)

FOREIGN PATENT DOCUMENTS

| | | |
|---|---|---|
| CA | 2249563 | 9/1997 |
| GB | 920004 | 3/1963 |
| JP | 06055825 A * | 3/1994 |

*Primary Examiner* — Laura Martin
(74) *Attorney, Agent, or Firm* — Simple IP Law, P.C.

(57) ABSTRACT

The present invention relates to an apparatus for printing pattern or indicia onto a gelatin ribbon. It comprises a transfer station with a print roll and a motor-driven casting roll provided for forming a gelatin ribbon. The transfer station is positioned in relation to the casting roll in such a way that the gelatin ribbon is sandwiched between the casting roll and the transfer station; elastic tackiness of a passing gelatin ribbon causes the rotation of the print roll. The apparatus further comprises an adjustment means, wherein the adjustment means are adapted to provide finely-tuned positioning of the transfer station in relation to the casting drum, and balance pressure exerted by the transfer station on the passing gelatin ribbon thus facilitating on optimal printing result.

6 Claims, 7 Drawing Sheets

U.S. PATENT DOCUMENTS 7,213,511 B2 * 5/2007 Cruttenden et al. ..... 101/40
2003/0056667 A1 * 3/2003 Cruttenden et al. ..... 101/219
2006/0096252 A1 * 5/2006 Nakamura et al. ..... 53/454

* cited by examiner

GELATIN RIBBON PRINTING METHOD AND APPARATUS

This application is based on a Provisional application Ser. No. 60/564,692 filed on Apr. 26, 2004.

The present invention relates to a method and apparatus for printing a pattern or indicia onto a gelatin ribbon, said ribbon being subsequently used in an encapsulation process. Encapsulation of products inside a gelatin shell has existed since the 1940s, the basics of which are described in U.S. Pat. No. 2,234,479.

In brief, a standard encapsulation process comprises two soft gelatin ribbons fused together by a die into capsules containing a product. As the gelatin ribbons are fused by the die, a liquid product is injected through tubes into the eventual capsules. Products may be anything from marking paint for paintball applications to pharmaceuticals intended to be swallowed by consumers.

BACKGROUND OF THE INVENTION

Considering the wide use of encapsulation by modern industry, there is a need to mark capsules with indicia or a pattern for identification or aesthetic purposes. Marking capsules in their final state is difficult and expensive, requiring extra labor and chemicals that may cause adverse effects to consumers. Thus, printing on the gelatin ribbon prior to the encapsulation process is more a cost-effective and accepted practice.

There is known U.S. patent application Ser. No. 10/236,669 for "Method and apparatus for printing a ribbon for packaging gelatin capsules" invented by Cruttenden, Holland, Tidy, and Rowe. This application uses a transfer station to mark the gelatin ribbon prior to encapsulation. The transfer station comprises a print roll (a flexographic printing plate wrapped around a cylinder) that picks up ink off an inking roller immersed in an ink tray. The transfer station is located along the gelatin ribbon's path between the casting drum and the oiling station. The print roll is in contact with the passing gelatin ribbon, driven by a motor at the same speed as the ribbon and depositing indicia or a pattern onto said ribbon. However, this application presents several disadvantages over the present invention. Firstly, it is over twenty times more expensive than the present invention: it requires sensitive and complex components such as a stepper motor, an encoder, prologic controls, speed controllers, air cylinders, and a gear drive assembly. Secondly, this application requires electricity and an air compressor to function. Considering the multitude and inter-dependence of components, this application is more prone to failure and down-time.

SUMMARY OF THE INVENTION

It is therefore the object of the present invention to provide an improvement to the above application. The transfer station of the present invention also comprises a print roll and an inking roll (anilox roll) immersed in an ink tray. However, instead of printing on the gelatin ribbon in mid-air thus necessitating an electric motor and logic controls to coordinate proper turning of the printing assembly, the apparatus of the present invention functions using the friction of the passing gelatin ribbon, which is an important part of the present invention. The transfer station of the present invention is positioned so that the passing gelatin ribbon is sandwiched between the motor-driven gelatin casting drum and the transfer station's print roll. The turning force and pressure exerted by the casting drum combined with the elastic tackiness of the gelatin ribbon causes the print roll to turn at the same speed as gelatin ribbon. Rotation of the print roll cause rotation of the anilox roll adjacent to the print roll.

Another important advantage of the present invention is the ease of routine preventive maintenance: the transfer station of the present invention can be removed, serviced and replaced much faster than U.S. patent application Ser. No. 10/236,669, thus resulting in improved productivity and reduced labor hours.

DETAILED DESCRIPTION OF THE PREFERRED EMBODIMENTS

The present invention relates to a method and apparatus for imprinting a pattern or indicia onto a cured gelatin ribbon in an encapsulation process. Instead of using an auxiliary driving means to turn the printing means, the present invention utilises pre-existing driving means in the form of the casting drum that shapes and feeds said gelatin ribbon. The invention relies on the combination of outwardly pressure and turning force exerted by said casting drum, pressure of the print roll and the elastic tackiness of said gelatin ribbon; said combination causes the present invention to function without resorting to auxiliary driving means, which is a substantial advantage of the present invention over all known prior art.

Figure 1:
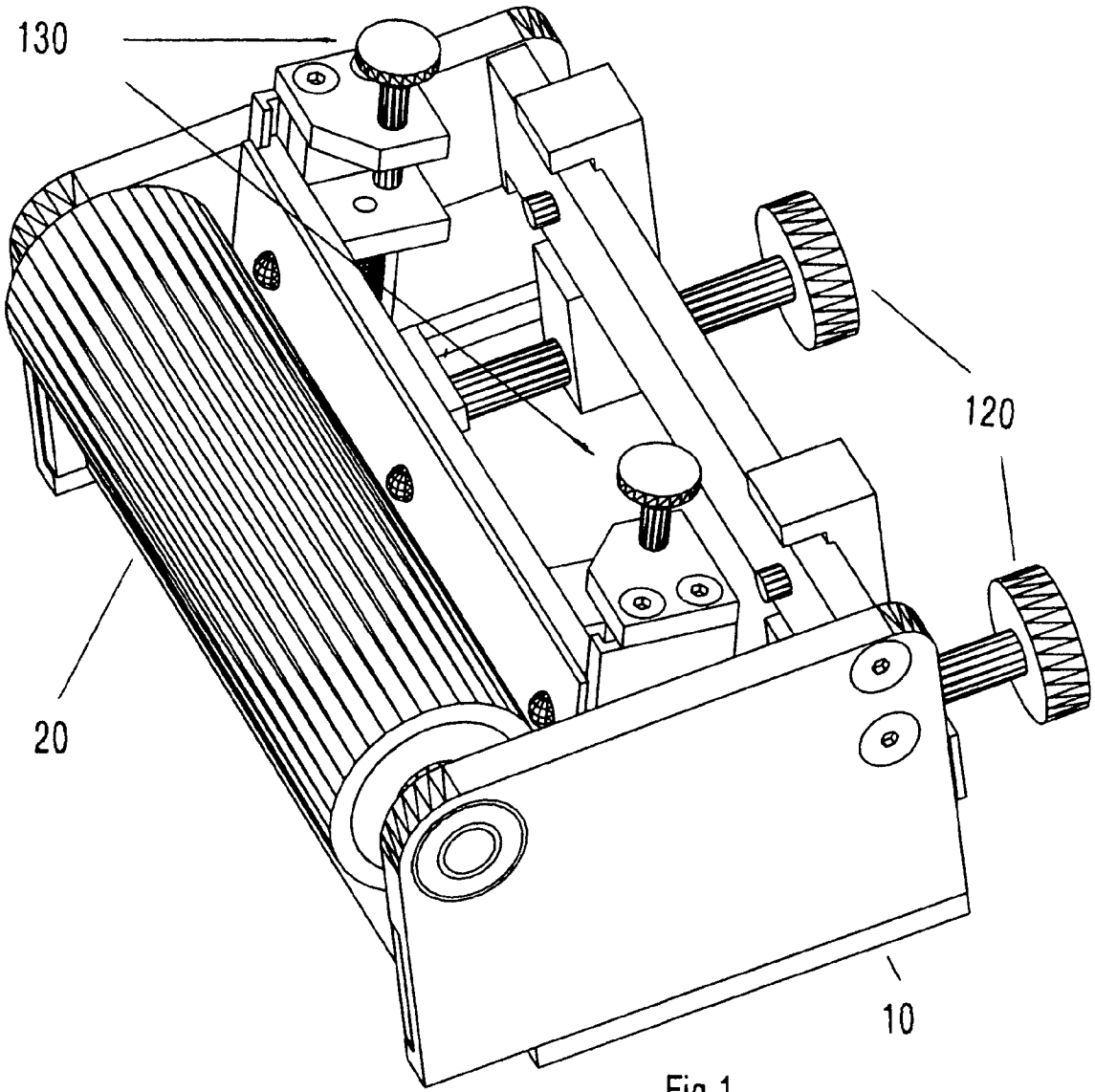
FIG. 1 is a perspective view of the transfer station according to the embodiment of present invention.
Figure 2:
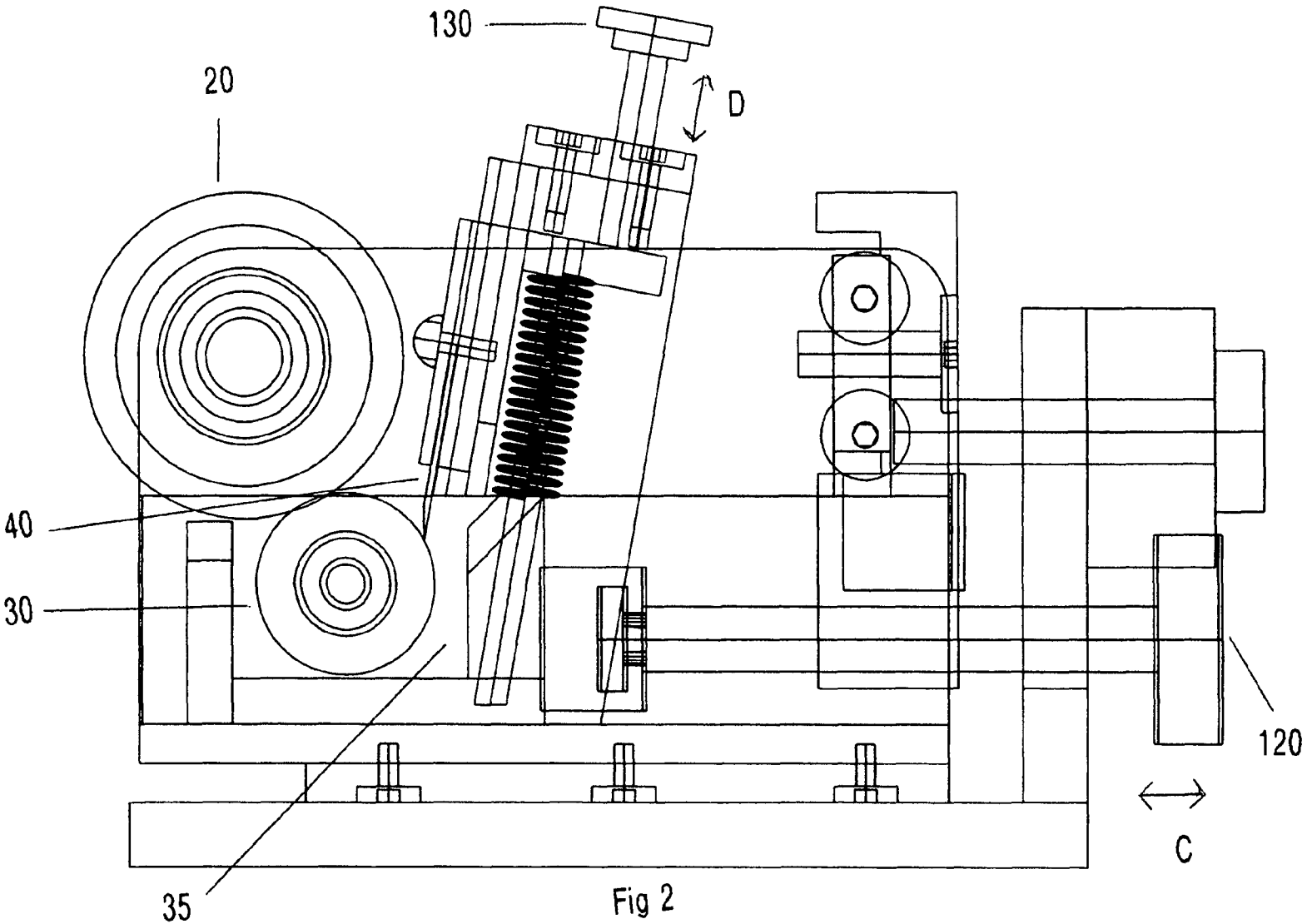
FIG. 2 is a side cross-sectional view of FIG. 1.
Figure 3:
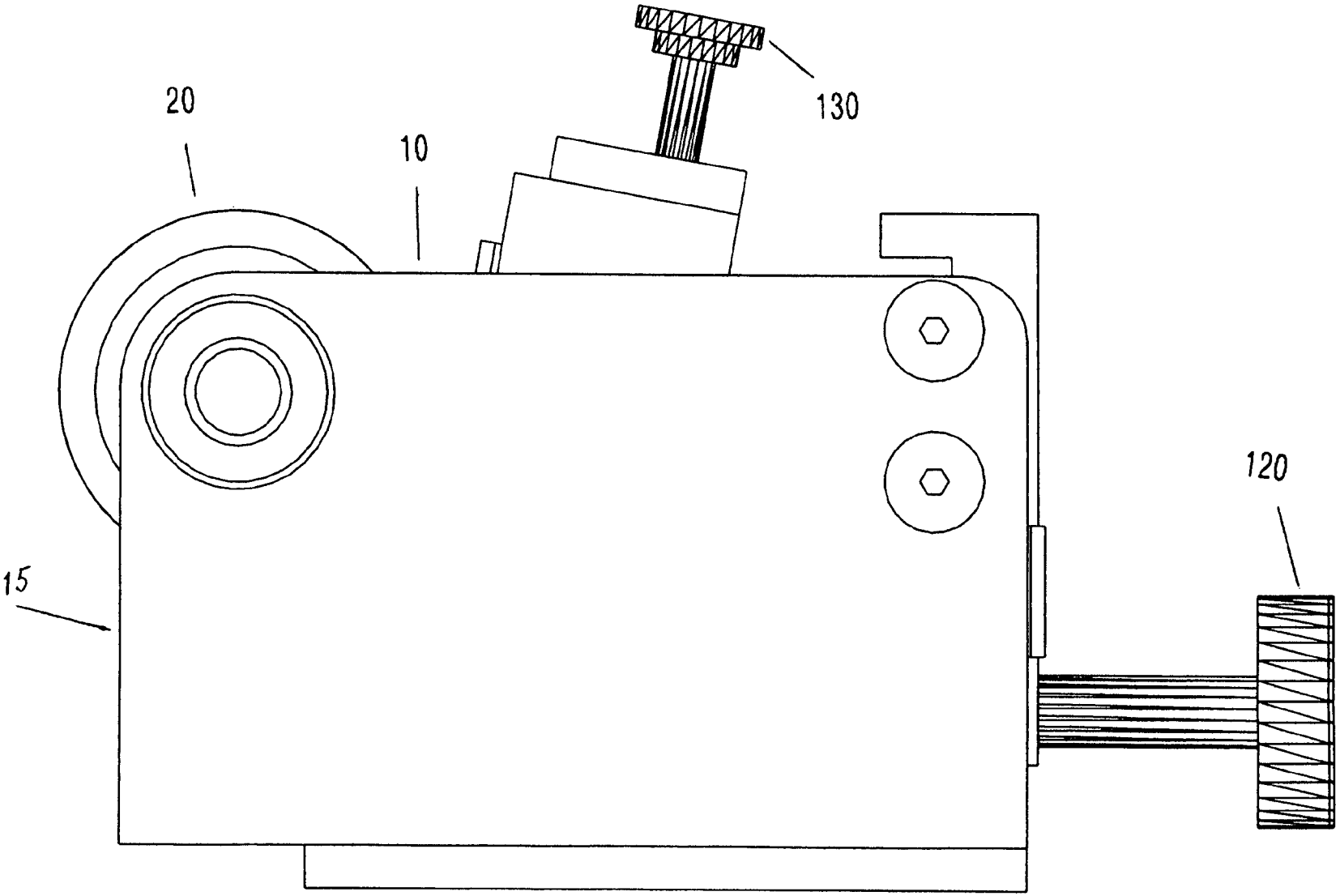
FIG. 3 is a side view of FIG. 1.

Referring to drawings, FIGS. 1-3 show the preferred embodiment of the printing apparatus according the present invention comprising a transfer station 10 placed into a housing 15 and having a print roll 20 and an inking or anilox roll 30. Print roll 20 is made of extruded rubber similar to a rubber stamp with a logo or pattern and anilox roll 30 is made of laser-engraved ceramic-coated stainless steel. A doctor blade 40 is mounted adjacent to the anilox roll 30 and is provided to scrape excess ink off said anilox roll. An ink tray 35 contains ink for printing. The anilox roll 30 acts as an ink-metering system and is partially submerged in the ink tray 35.

Positioning of the transfer station 10 in relation to the casting drum 60 and regulating optimal pressure exerted by the print roll 20 on the gelatin ribbon 70 is provided by different adjustment means shown on FIGS. 1-7, described below.

FIG. 1 shows third adjustment means that are located on the transfer station 10, comprising two knobs 120 facilitating forward/backward movements of the anilox roll 30 towards the print roll 20 (movement shown by arrows C). Fourth adjustment means are located on the transfer station 10, comprising two knobs 130 that facilitate movements of doctor blade 40 towards anilox roll 30 (shown by arrows D).

FIG. 2 shows a cross-sectional view of transfer station 10, showing anilox roll 30 in ink tray 35 and doctor blade 40 adjacent to anilox roll 30.

Figure 4:
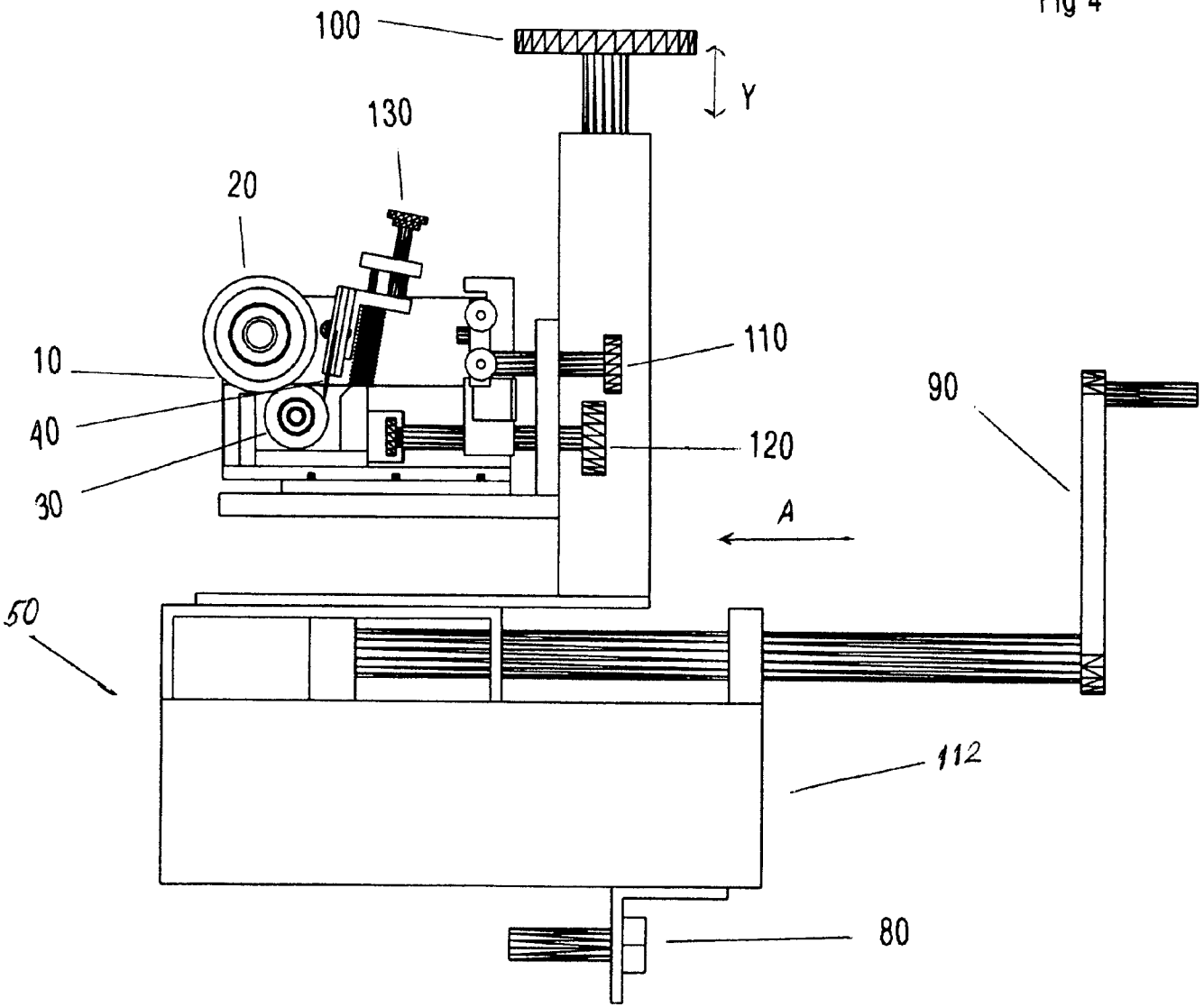
FIG. 4 is a side cross-sectional view of the transfer station of FIG. 1 mounted on its base assembly.
Figure 5:
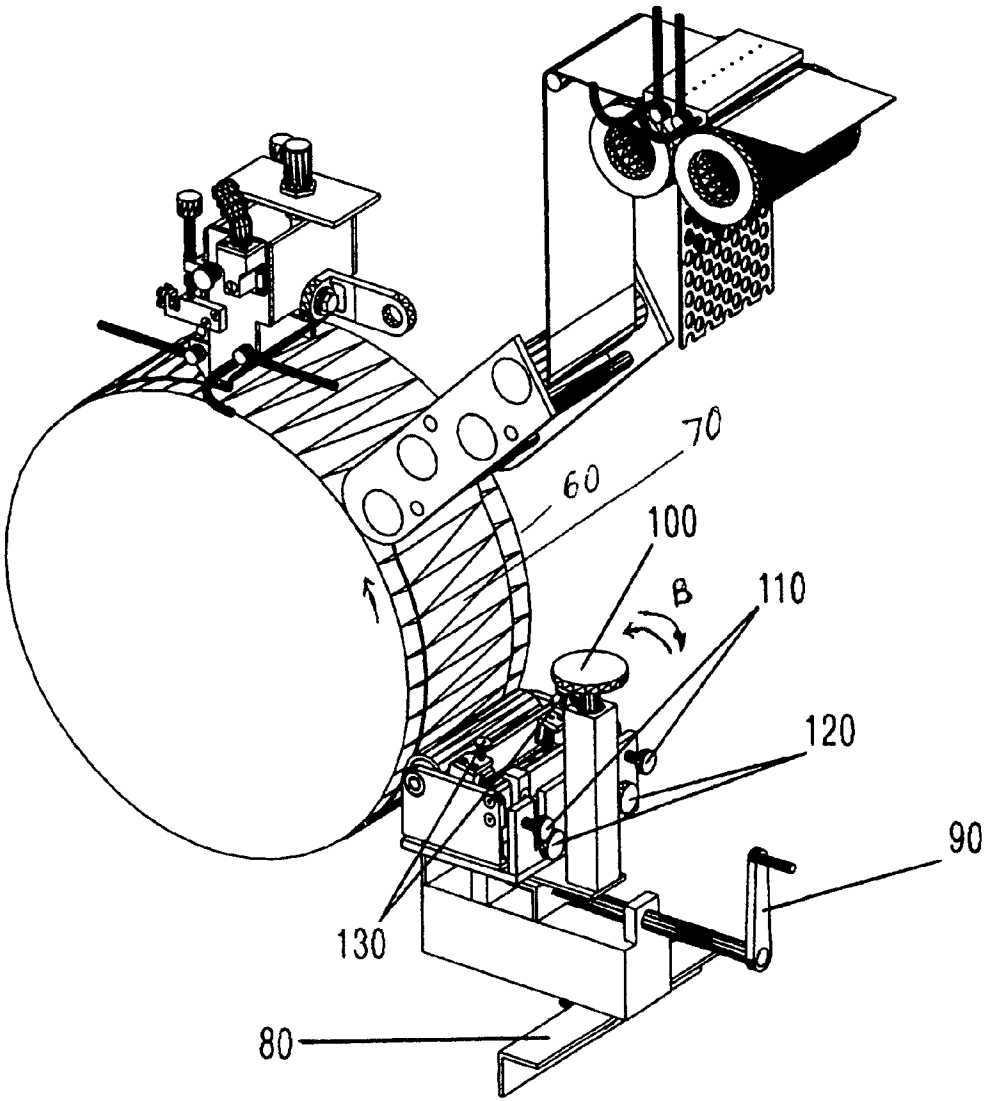
FIG. 5 is a perspective view of the present invention in use.

FIG. 4 is a side cross-sectional view of the preferred embodiment and FIG. 5 is a perspective view of the preferred embodiment in operational mode. These Figures show transfer station 10 having print roll 20, anilox roll 30 in ink tray 35 and doctor blade 40 adjacent to anilox roll 30. Transfer station 10 is removably mounted on a base assembly 50 by means of a mounting bolt (not shown). First adjustment means are located on the base assembly 50 and comprise a mount bracket 80 having an elongated slot 56 provided for mounting screw 55 facilitating lateral left/right adjustments for setting base assembly 50 in exact alignment with the casting drum 60 (shown by arrows X). Second adjustment means are located on the base assembly 50 and comprise a crank 90 facilitating forward/backward adjustment of the transfer station 10 towards the casting drum 60 (shown by arrows A). Fifth adjustment means are located on the base assembly 50 and comprise a knob 100 facilitating vertical up/down adjustment of the transfer station 10 (shown by arrows Y). Sixth adjustment means are located on the transfer station 10 and comprise two knobs 110 facilitating pivotal adjustments of the transfer station 10 in a horizontal plane (shown by arrows B). All six adjustment means are operated manually.

To achieve optimal printing results, print roll 20 of the transfer station of the present invention 10 must remain in a finely-tuned balance with moving gelatin ribbon 70, wherein said print roll turns at the same speed as gelatin ribbon 70. Gelatin ribbon 70's elastic and tacky properties are ideally mated to print roll 20's rubber coating. However, if print roll 20 is placed too close to gelatin ribbon 70, it will cause said ribbon to stretch, deform or tear; if the print roll 20 is placed too far from ribbon 70, it will lack the necessary friction to turn at the same speed as gelatin roll 70, thus blurring or distorting the desired printed image. To maintain this balance, the preferred embodiment has six manual adjustment movements, which is an important feature of the present invention.

Figure 6:
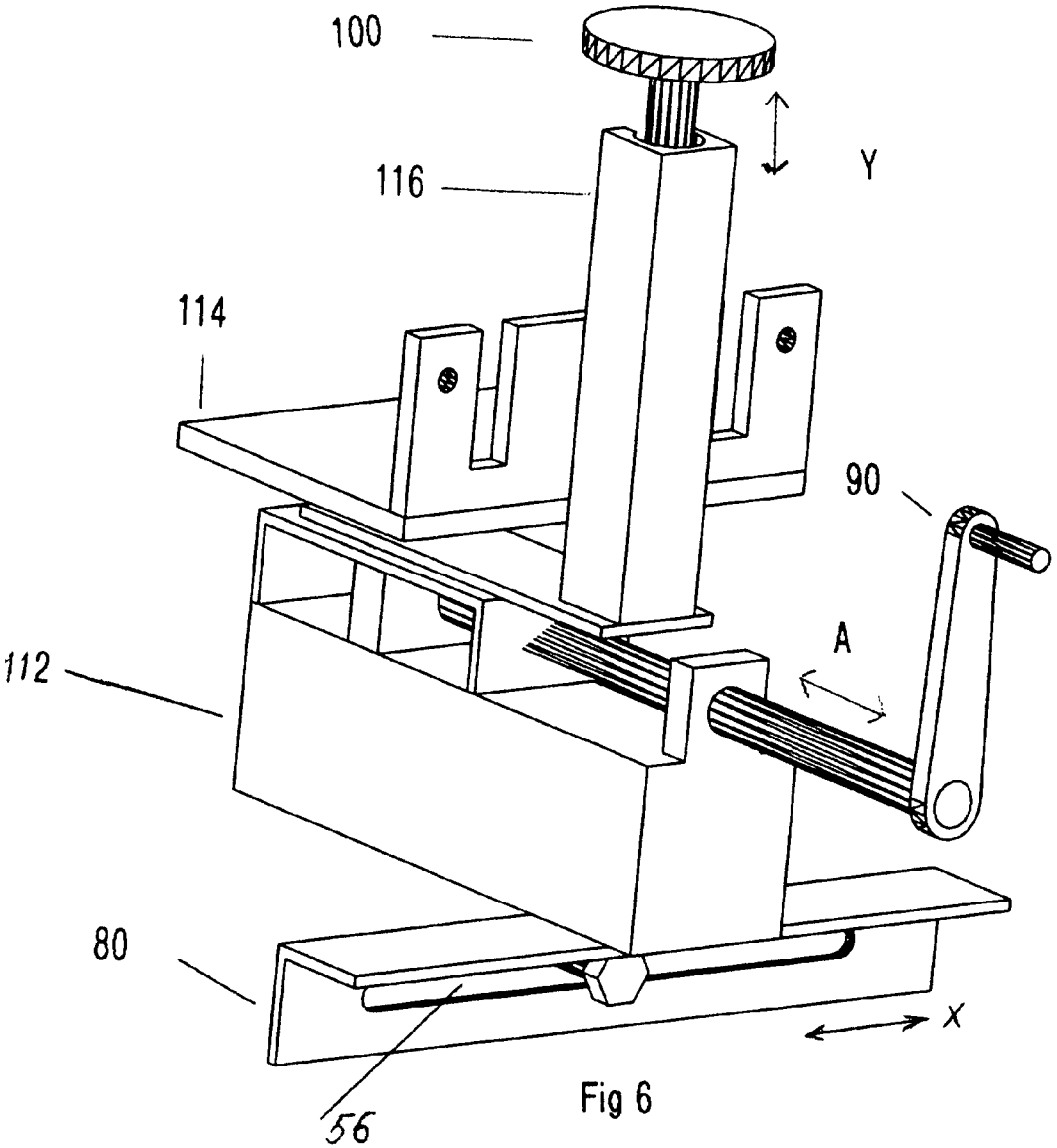
FIG. 6 is a perspective view of the base assembly of FIG. 4.
Figure 7:
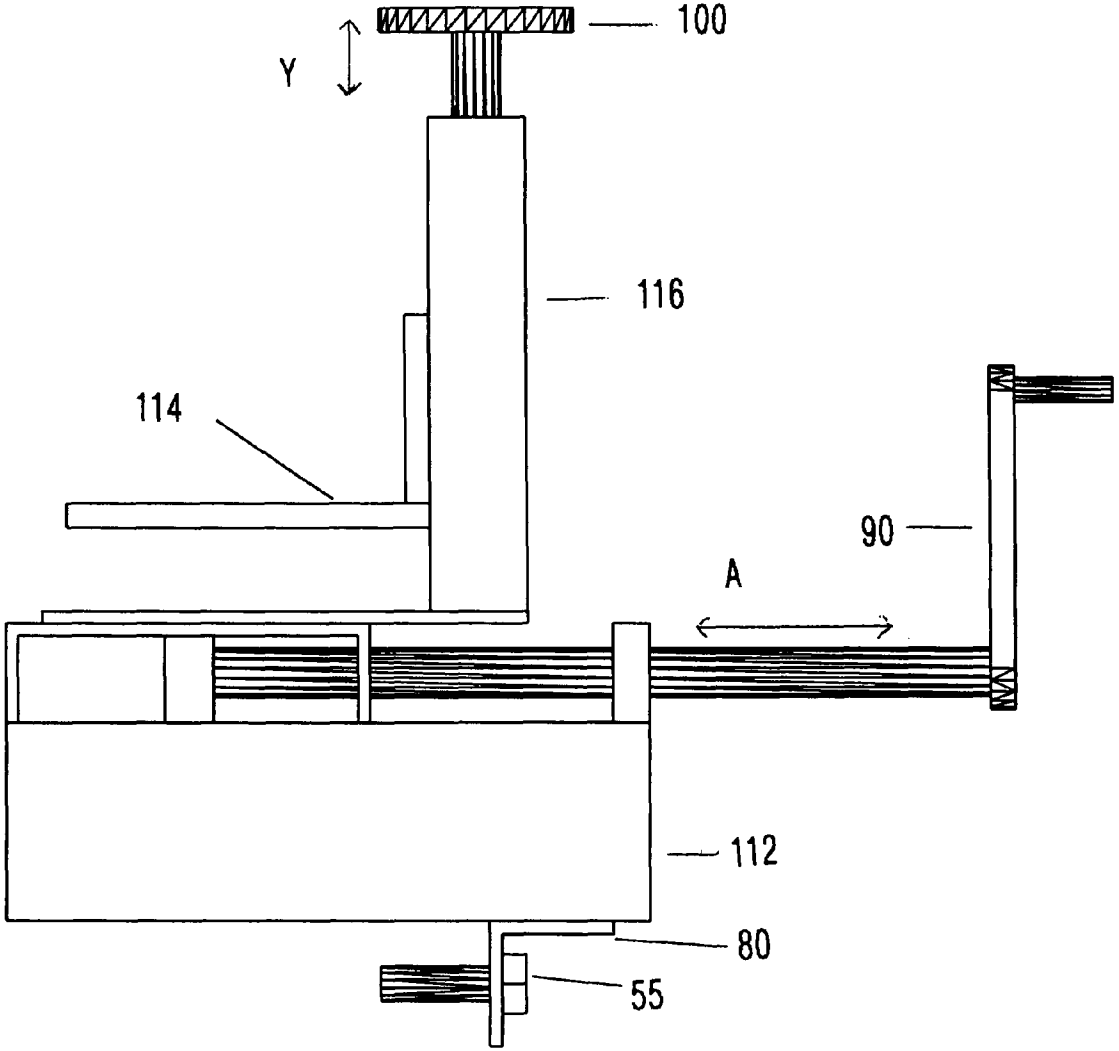
FIG. 7 is a side view of FIG. 6.

FIGS. 6 and 7 depict the base assembly 50 of the present invention comprising the mounting bolt 55 provided to fasten the mounting bracket 80 by means of bracket slot 56 to the base assembly 50. Base channel 112 is provided to house the crank 90 adapted to adjust the forward/backward movements of the transfer station 10. Base channel 116 is provided to house knob 100 to adjust up and down movements of platform 114. Platform 114 is provided for mounting the transfer station 10 onto the base assembly 50. Height adjustment channel 116 is provided to house the height adjustment knob 100 facilitating vertical up/down adjustments of the transfer station 10.

With reference to FIG. 5, the first step in aligning transfer station 10 with gelatin ribbon 70 begins with setting base assembly 50 in an exact alignment with casting drum 60 on the mount bracket 80 using mounting screw 55 inserted into the bracket slot 56. Mount bracket 80 allows for lateral left/right adjustment movement, as identified by arrows X. Once base 50 is in exact alignment with drum 60, transfer station 10 is moved toward drum 60 using crank 90, wherein the crank 90 controls forward/backward adjustment movement as identified by arrows A.

Transfer station 10 is moved toward drum 60 until print roll 20 comes in contact with moving gelatin ribbon 70 and begins to turn due to ribbon 70's motion. Anilox roll 30 is moved toward print roll 20 using knobs 120 so that anilox roll 30 makes contact with print roll 20; knobs 120 control anilox roll 30 forward/backward adjustment movement identified by arrows C. Print roll 20's turning motion is transferred to anilox roll 30, and anilox roll 30 starts picking up ink out of ink well 35. Doctor blade 40 is adjusted using knobs 130 so that it exerts an even pressure along the length of anilox roll 30, wherein knobs 130 control doctor blade 40 pressure adjustment movement as shown by arrows D on FIG. 2. As anilox roll 30 turns and picks up ink out of ink well 35, doctor blade 40 subsequently scrapes off excess ink leaving only the appropriate amount of ink on anilox roll 30. Ink is transferred from the anilox roll 30 through contact to print roll 20, which in turn transfers said ink to gelatin ribbon 70.

Balance between transfer station 10 and gelatin ribbon 70 can also be finely-tuned using knob 100, being vertical up/down base adjustment movement shown by arrows Y on FIG. 4, as well as knobs 110 facilitating horizontal pivotal adjustment movement shown by arrows B on FIG. 5. The amount of ink that is allowed to transfer to print roll 20 can be controlled through the third or anilox roll adjustment movement provided by knobs 120 (arrows C) and fourth or doctor blade 40 pressure adjustment movement provided by knobs 130 (arrows D). It must be emphasized that the present invention is not restricted to the sequence of adjustment steps shown above and any other possible sequence of steps may be used for the same purpose with the same final result.

The present invention has the following advantages over prior art, in particular U.S. application Ser. No. 10/236,669:

- it does not use any utilities;
- all adjustments are made manually, which is very important feature of the present invention;
- the printing apparatus of the present invention is not gear driven, electrically powered or pneumatically driven;
- there is no need for stepping motors, speed controllers or any other similar means, thus eliminating potential malfunctions and need for routine maintenance.

It must be emphasized that present invention is not restricted to the use of printing apparatus shown on FIGS. 1-3; any similar equivalents could be used for the same purpose. Adjustment means also are not restricted to the embodiments shown above and any other equivalent arrangements could be used for the same purpose within the scope of the present invention.

Thus, it can be seen that the objects of the present invention have been satisfied by the structure presented hereinabove. While in accordance with the Patent Statutes, only the best mode and preferred embodiments of the present invention have been presented and described in detail, it is to be understood that the invention is not limited thereto or thereby. Accordingly, for an appreciation of the true scope and breadth of the invention, references should be made to the following claims.

The invention claimed is:

1. An apparatus for printing on a gelatin ribbon comprising:

a motor driven cylindrical casting drum which forms a gelatin ribbon around a portion of its outer periphery, a cylindrical print roll having a pattern formed on and around its outer periphery, said print roll positioned relative to said casting drum so that said gelatin ribbon is sandwiched in between and in contact with both said casting drum and said print roll and so that the print roll is rotary driven by said casting drum solely through frictional contact with the gelatin ribbon, an ink tray containing ink, a rotary ink roller having a first portion submerged in the ink in said ink tray and a second portion in contact with the outer periphery of said print roll so that rotation of said print roll rotatably drives said ink roller in synchronism with said print roll solely through frictional contact between said print roll and an inked portion of said inking roller, said ink roller transferring ink onto said patter on said print roll and said print roll transferring ink from said pattern onto said gelatin ribbon during rotation of said casting drum, said print roll and said ink roller, a doctor blade having an edge arranged closely adjacent to an outer periphery of said inking roller, such that said doctor blade is configured to scrape excess ink from said inking roller during operation of the apparatus, and a manually operated print roll adjustment mechanism configured to provide the sole mechanism for adjusting the position of said print roll relative to said casting drum.

2. The apparatus as defined in claim 1 wherein said print roll adjustment mechanism comprises two screws, one screw associated with each end of said print roil so that the position of each end of said print roil is independently adjustable relative to said casting drum.

3. The apparatus as defined in claim 1 and comprising a manually operated ink roller adjustment mechanism operable to adjust the position of said ink roller relative to said print roll.

4. The apparatus as defined in claim 3 wherein said ink roller adjustment mechanism comprises two screws, one screw associated with each end of said ink roller so that the position of each end of said ink roller is independently adjustable relative to said print roll.

5. The apparatus as defined in claim 1 and comprising a manually operated doctor blade adjustment mechanism operable to adjust the position of said doctor blade relative to said ink roller.

6. The apparatus as defined in claim 5 wherein said doctor blade adjustment mechanism comprises two screws, one screw associated with each end of said doctor blade so that the position of each end of said doctor blade is independently adjustable relative to said inking roller.

* * * * *